United States Patent [19]

Maslenikow

[11] 3,947,908

[45] Apr. 6, 1976

[54] LIFE-SAVING APPLIANCE

[76] Inventor: Andrey Maslenikow, 180 Parsippany, Boonton, N.J. 07005

[22] Filed: Dec. 3, 1974

[21] Appl. No.: 529,031

[52] U.S. Cl. ..... 9/318

[51] Int. Cl.[2] ..... B63C 9/16

[58] Field of Search ..... 9/311–327; 222/5

[56] References Cited

UNITED STATES PATENTS

| | | | |
|---|---|---|---|
| 2,979,740 | 4/1961 | Walker et al. | 9/316 |
| 3,812,546 | 5/1974 | Witte | 9/319 |

*Primary Examiner*—Trygve M. Blix
*Assistant Examiner*—Sherman D. Basinger
*Attorney, Agent, or Firm*—Martin P. Hoffman; James H. Ewing

[57] ABSTRACT

A life-saving appliance that automatically inflates an inflatable tube after a short period of contact with water comprising a metallic receptacle containing a refrigerant in the liquid stage, a membrane normally sealing the receptacle, a manually-actuated pin for penetrating the membrane, an inflatable tube surrounding the receptacle, a conduit for connecting the interior of the receptacle to the tube, and a water-soluble retaining band for holding the tube, in deflated condition, against the exterior of the receptacle. The appliance is compact in its normal, unactuated condition and can be thrown several feet outwardly over a body of water with significant accuracy; shortly after contact with the water, the retaining strip disintegrates and the refrigerant passes through the membrane, which has already been punctured, to rapidly expand and fill the inflatable tube.

2 Claims, 4 Drawing Figures

LIFE-SAVING APPLIANCE

BACKGROUND OF THE INVENTION

1. Field of the Invention

This invention relates generally to life-saving appliances, employing inflatable tubes as life preservers, and more particularly, to such appliances that are compact in size and can easily be thrown to a person in distress to assist in the rescue of such person.

2. Description of the Prior Art

Life-saving appliances employing inflatable tubes and individual pressurized containers therefor are well-known. Generally, in order to facilitate the handling and storage of such appliances prior to their usage, the tubes are deflated and the pressurized containers are retained in their unactuated condition by a valve-locking mechanism that may assume several forms, including the form of a spring-operated mechanical timing mechanism, a water-soluble pellet, or a water-soluble strap. A representative mechanical-timing mechanism is disclosed in U.S. Pat. No. 2,857,078, granted to H. Wolpert; a representative water-soluble capsule is disclosed in U.S. Pat. No. 3,350,730, granted to Kubit, et al.; and a representative water-soluble strap is disclosed in U.S. Pat. No. 3,682,354, granted to Witte. Each of these representative prior art, life-saving appliances suffers from one or more of the deficiencies noted hereinafter.

To illustrate, the several components of the mechanical-timing mechanism disclosed by Wolpert are relatively expensive to manufacture and properly assemble with the extreme degree of reliability necessary for successful operation of life-saving appliances. Also, by virtue of the manner in which the timing mechanism is interposed between the deflated tubular life preserver and the capsule of compressed gas, the life-saving appliance is bulky and cannot be thrown an appreciable distance. The water-soluble capsules employed by Kubit et al. exhibit a tendency to crumble or disintegrate and thus prematurely release the locking mechanism for the valve operator of the pressurized fluid container. Witte thus suggests replacing the water-soluble capsule with a liquid deteriorative strap that more effectively retains the locking mechanism for a pressurized fluid container in its normally unactuated condition. In both instances, the life-saving appliance is housed within a casing that has holes formed therein so that the capsule, or strap, can be completely wetted when the housing is immersed in water. However, in order to allow the inflatable tube to expand, the person in distress in the water must open such housing to allow the inflatable tube to expand, a seemingly simple task under normal circumstances, but one that may create problems when panic overwhelms the distressed user of these appliances.

SUMMARY OF THE INVENTION

Consequently, with the deficiencies of the known life-saving appliances enumerated above clearly in mind, the instant invention contemplates a compact life-saving appliance that can be easily and accurately thrown several feet in much the same fashion as pitching a baseball. Since the inflatable tube is secured about the exterior of the metallic receptacle by a retaining band, and a housing is omitted, the person in distress must merely grasp the life preserver as it is automatically inflated. Furthermore, the unique life-saving appliance disclosed hereinafter is sturdy and will not be adversely affected by shocks, humid weather, or age, conditions which exact a heavy toll upon life-saving appliances utilizing water-soluble capsules.

Other advantages of the instant invention will become apparent to those skilled in the art upon consideration of the accompanying specification, claims, and drawings.

DESCRIPTION OF THE PREFERRED EMBODIMENT

Figure 1:
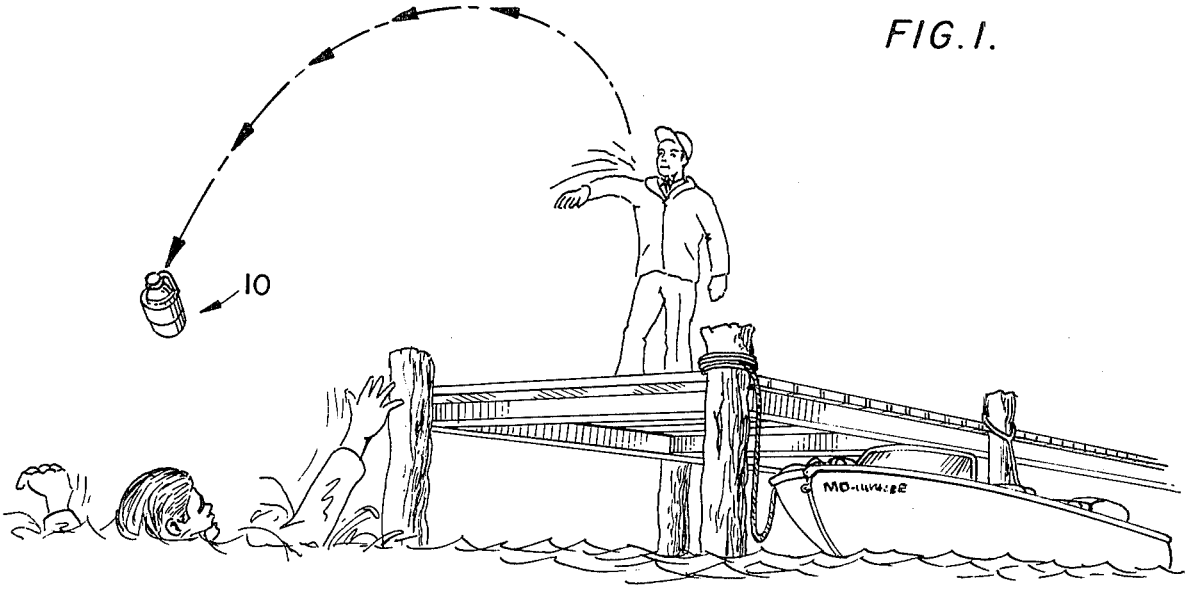
FIG. 1 is a diagrammatic representation of the manner in which the instant life-saving appliance prior to inflation is utilized.
Figure 2:
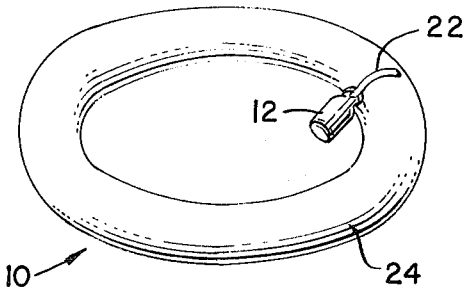
FIG. 2 is a perspective view of the instant life-saving appliance after inflation thereof.
Figure 3:
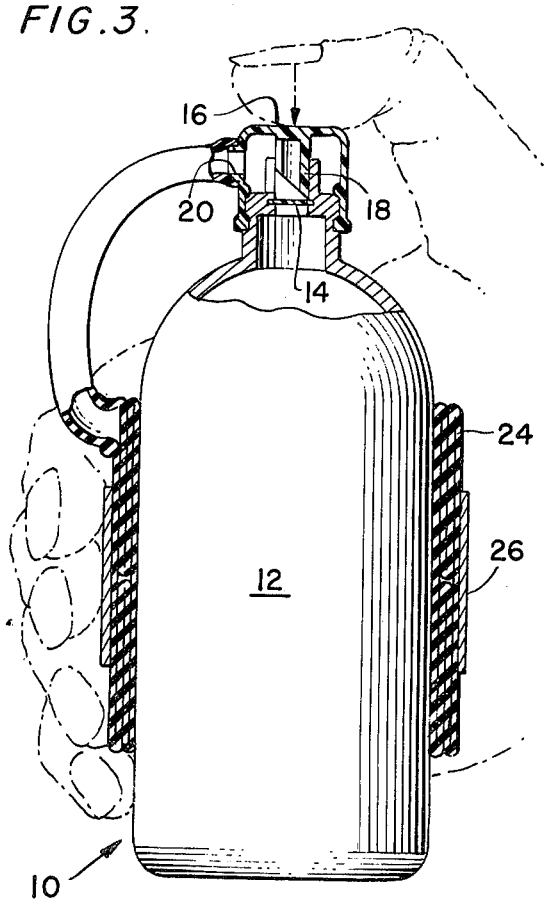
FIG. 3 is a diagrammatic representation on an enlarged scale of the manner in which the contents of the metallic receptacle are released.

Referring now to FIGS. 1-3 of the drawings, wherein like reference characters identify like parts, the life-saving appliance, constructed in accordance with the principles of my invention, is indicated generally by reference numeral 10. Appliance 10 comprises a metallic receptacle 12 containing a refrigerant, such as propane, in its liquid state. A membrane 14 normally seals the upper end of the neck of the receptacle and isolates the contents of the receptacle from ambient conditions. Cap 16, with a hollow depending pin 18 is secured to the neck of the receptacle so that the pin is normally positioned slightly above the membrane 14. An annular stub 20 is molded at one side of cap 16.

A short length of conduit 22 extends between inflatable tube 24 and cap 16 to permit communication therebetween. As shown in FIGS. 1 and 3, the tube 24 is normally wrapped around the body of receptacle 12 in its deflated condition. A retaining band 26 holds the tube in fixed position about the receptacle.

Figure 4:
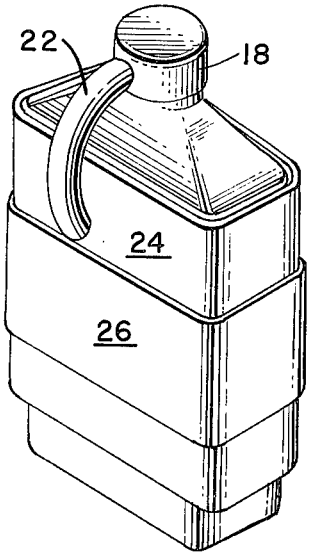
FIG. 4 is a perspective view of an alternative embodiment of the instant life-saving appliance.

In the alternative embodiment of FIG. 4, a metallic receptacle 28 of generally rectangular configuration is substituted for substantially cylindrical receptacle 12. In all other material respects, the life-saving appliance remains unchanged.

Life-saving appliance 10 operates in the manner described hereinafter, assuming that such appliance is carried upon the person of a policeman, lifeguard, watchman, etc. or secured to a pier, or within a boat, in a readily-accessible location. Upon seeing, or hearing, that a person in the water is in distress, the person at the water's edge grasps appliance 10 in his hand and manually depresses cap 16 so that pin 18 breaches membrane 14. After depression of the cap, the person at the water's edge throws appliance 10 toward the person in distress. Since band 26 retains tube 24 in its flattened condition, the appliance, which may employ an aluminum receptacle that is 5 inches in length and has a 24-inch diameter, can be thrown with great accuracy for distances of several feet, perhaps even up to 80 feet.

The refrigerant held within receptacle 12 slowly passes through conduit 22 into tube 24, but the tube remains flattened under the influence of band 26. Band 26, which may be formed of paper, cardboard, felt, or the like, has significant strength when dry. However, once wetted by contact with the water, the band deteriorates rapidly and enables the pressure caused by the rapid volumetric expansion of the refrigerant within tube 24 to free the tube from its prior constraint so that it may assume its inflated doughnut, or toroidal-shaped configuration.

While two embodiments of the instant life-saving appliance have been disclosed in the foregoing description, it will be understood that various modifications and refinements will occur to those skilled in the arts to which this invention appertains. For example, although receptacle 12 advantageously contains a liquid refrigerant, such as propane, which rapidly expands under atmospheric pressure to turn into a gas that occupies a volume approximately 35 times greater than its volume as a liquid, a pressurized carbon dioxide cartridge could be utilized with some degree of efficacy. Also, several varieties of spring-loaded valve mechanisms could be employed in lieu of pin 18 and membrane 14 to release the contents of receptacle 12. Hence, the appended claims should not be limited to their exact terms, but should be broadly construed in a manner commensurate with the scope of the inventive contribution to the useful art and science.

What is claimed is:

1. A life-saving appliance comprising:

a. a receptacle containing a fluid that expands rapidly under ambient conditions;

b. sealing means extending across said receptacle for isolating the fluid from ambient conditions;

c. normally unactuated means operable, when manually actuated, to breach said seal;

d. an inflatable tube positioned about said receptacle in its normally deflated condition, said deflated tube being compressed so that it can conform to the configuration of said receptacle;

e. conduit means connected between said receptacle and said inflatable tube to serve as a flow path therebetween;

f. a band of material wrapped about said tube, in its deflated condition, to retain said tube in fixed position pressing against the exterior of said receptacle;

g. said band quickly losing its strength when coming in contact with water so that said deflated tube is filled by the rapid expansion of the fluid passing from the interior of the receptacle through the conduit means and thence into the inflatable tube after the means for breaching the sealing means have been manually actuated prior to throwing said life-saving appliance into the water.

2. A life saving appliance as defined in claim 1 wherein said receptacle has a neck at its upper end and said sealing means includes a cap that fits upon said neck, said cap including a pin for breaching said sealing means and a stub for receiving one end of said conduit means.

* * * * *